US006923152B2

(12) United States Patent
Nagai et al.

(10) Patent No.: US 6,923,152 B2
(45) Date of Patent: Aug. 2, 2005

(54) ENGINE STARTER

(75) Inventors: Toru Nagai, Tokyo (JP); Hayato Yamauchi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/414,241

(22) Filed: Apr. 16, 2003

(65) Prior Publication Data

US 2004/0107931 A1 Jun. 10, 2004

(30) Foreign Application Priority Data

Dec. 10, 2002 (JP) ..... 2002-357843
Dec. 10, 2002 (JP) ..... 2002-357845

(51) Int. Cl.[7] ..... F02N 11/00
(52) U.S. Cl. ..... 123/179.25; 290/38 R; 74/7 A
(58) Field of Search ..... 123/179.1, 179.25; 290/38 R; 74/7 A

(56) References Cited

U.S. PATENT DOCUMENTS 4,418,289 A * 11/1983 Mortensen ..... 290/38 R
6,360,707 B1 * 3/2002 Boegner ..... 123/179.25

FOREIGN PATENT DOCUMENTS

| | | |
|---|---|---|
| JP | 05-180130 B2 | 7/1993 |
| JP | 09-177644 A | 7/1997 |
| WO | WO 99/26266 A1 | 5/1999 |

* cited by examiner

*Primary Examiner*—Andrew M. Dolinar
(74) *Attorney, Agent, or Firm*—Sughrue Mion, PLLC

(57) ABSTRACT

An engine starter includes a starter switch having a plunger assembly movable between non-operating operating positions. When the plunger assembly is at the non-operating position, a gap between main stationary and movable contacts is smaller than the sum of a gap between a pinion and an engine ring gear and the most-widely opened variable gap, which is defined between a drive mechanism and a moving shaft. The arrangement is such that, as the plunger assembly moves from the non-operating position to the operating position, the auxiliary contact is first closed to cause the starter motor to be driven at the first speed, and then the main contact is closed to cause the starter motor to be driven at the second speed.

8 Claims, 7 Drawing Sheets

ENGINE STARTER

BACKGROUND OF THE INVENTION

1. Field of the Invention

This invention relates to an engine starter used to start an internal combustion engine, and in particular, to an engine starter equipped with a magnet switch.

2. Description of the Related Art

In a magnet switch provided in a conventional auxiliary rotation type engine starter, there are provided a main contact and an auxiliary contact in order to control the operation of the starter motor at the time of engine start in two stages, and a resistor is connected in series to a circuit formed by closing the auxiliary contact, connecting a battery and the armature of the motor to each other. On the other hand, a circuit formed by closing the main contact allows direct connection of the battery and the armature of the motor. When the start switch is turned on, an electric current is caused to flow to an attraction coil, and the auxiliary contact is closed, the electric current flowing from the battery to the motor armature by way of the resistor, so that a pinion provided on the motor shaft and a ring gear are smoothly engaged with each other, and then the main contact is connected to effect transition to rated rotation. There are provided different plungers respectively for the main contact and the auxiliary contact (See, for example, JP 7-109967 A, paragraph 0009, FIG. 1).

However, since the main contact and the auxiliary contact are driven respectively by the different plungers, the size of the starter has to be rather large, which is disadvantageous from the viewpoint of the layout of the terminals and the peripheral components. In view of this, of the main contact and the auxiliary contact, the movable one is used in common, and, at the same time, the resistor is also contained in the magnet switch to thereby achieve a reduction in size (See, for example, JP 7-174062 A, paragraph 0009, FIG. 2).

However, in a magnet switch in which a retraction coil and a holding coil are separately provided, the retraction coil and the holding coil are constructed in the same form in order to avoid the holding force of the movable element due to the induced back electromotive force after the opening of the ignition switch, with the result that the retracting speed of the movable element is increased. Thus, the coil for driving the movable element is formed by a single stage of attraction coil having high inductance, and the resistor contained in the magnet switch is connected in series to the auxiliary contact, the main contact and the auxiliary contact being opened and closed stepwise to cause an electric current to flow through the armature of the motor (See, for example, JP 2001-508855 A).

In such a magnet switch, which has a construction in which the movable one of the main contact and the auxiliary contact held by the same plunger is axially moved, the auxiliary contact is further pushed in after its turning on until the main contact is turned on, so that the push-in amount of the auxiliary contact in rated rotation is rather large. When the start switch is turned off, the plunger is returned by a distance corresponding to the clearance of the lever hook and the main contact is turned off. However, after this, an electric current flows further to the motor through the resistor connected to the auxiliary contact, so that the starter tries to run the engine and there is a fear of the auxiliary contact not being turned off. Thus, due to continuous current supply to the resistor, there is a danger of heat damage.

Further, in order to prevent the main contact from being turned on when the pinion abuts the end surface of the ring gear and to enable the auxiliary contact to be turned on without fail, it is necessary to achieve an improvement in terms of the dimensional accuracy of the components of the engine starter and the mounting precision for the pinion and the ring gear, resulting in an increase in cost.

Further, the arrangement of the resistor formed by bending a resistor wire with insulation coating into a meandering shape in the outer periphery of the switch coil leads to the following problem: when the engagement of the ring gear with the pinion is not effected successfully in a short period of time, a large electric current repeatedly flows through the resistor to cause the resistor to generate heat, thereby causing heat damage to the switch coil. Further, due to the heat generation of the switch coil, the resistance value of the resistor undergoes changes with passage of time, which may lead to a great variation in the RPM of the starter motor.

Further, the resistor is prepared by working a resistance wire, so that when changing the resistance value of the resistor and the rated current value, etc. in order to change the characteristics of the engine starter, it is necessary to change the diameter, etc. of the resistor wire. Thus, in some cases, the distance between the casing and the switch coil is smaller than the wire diameter, making it necessary to change the casing.

SUMMARY OF THE INVENTION

It is an object of the present invention to provide an engine starter equipped with a starter switch which performs rated rotation after gentle engagement of the ring gear with the pinion, which has a large dimensional margin for the production of the auxiliary contact, and which has an auxiliary contact reliably realizing a contact-off state upon contact opening operation.

Another object of the present invention is to provide an engine starter equipped with a magnet switch in which the resistor is arranged so as to reduce the heat damage to the switch coil.

According to an aspect of the present invention, an engine starter has a starter switch which includes a switch coil, a plunger assembly movable between a non-operating position and an operating position by the switch coil, a main and auxiliary movable contact provided in the plunger assembly, a main and auxiliary stationary contact pair with which the main and auxiliary movable contact can be brought into and out of contact, and a drive mechanism provided between the plunger assembly and the pinion and adapted to cause the pinion to advance and retreat. The plunger assembly includes a movable element driven between the non-operating position and the operating position by the switch coil, and a shaft elastically supported by the movable element so as to be movable in the moving direction of the movable element and connected to the drive mechanism with a gap variable with respect to the movable element. The size of a gap between the main stationary contact pair and the main movable contact when the plunger assembly is at the non-operating position is arranged to be smaller than the sum total of the size of a gap between the pinion and the ring gear and the size of the variable gap when opened to the utmost, so that as the plunger assembly moves from the non-operating position to the operating position, the auxiliary contact is first closed to cause the starter motor to be driven at the first speed, and then the main contact is closed to cause the starter motor to be driven at the second speed.

Further, according to another aspect of the present invention, an engine starter includes a starter motor, a pinion driven by the starter motor and capable of advancing and retreating with respect to a ring gear of an engine for engagement therewith, and a starter switch having a main contact pair and an auxiliary contact pair for driving the starter motor at first and second speeds different from each other, a resistor connected to the auxiliary contact pair, a switch coil for bringing the main and auxiliary contact pairs into and out of contact with each other, and a drive mechanism for causing the pinion to advance and retreat, in which the resistor is provided adjacent to the switch coil through the intermediation of a heat insulating layer.

DETAILED DESCRIPTION OF THE PREFERRED EMBODIMENTS

Embodiment 1

Figure 1:
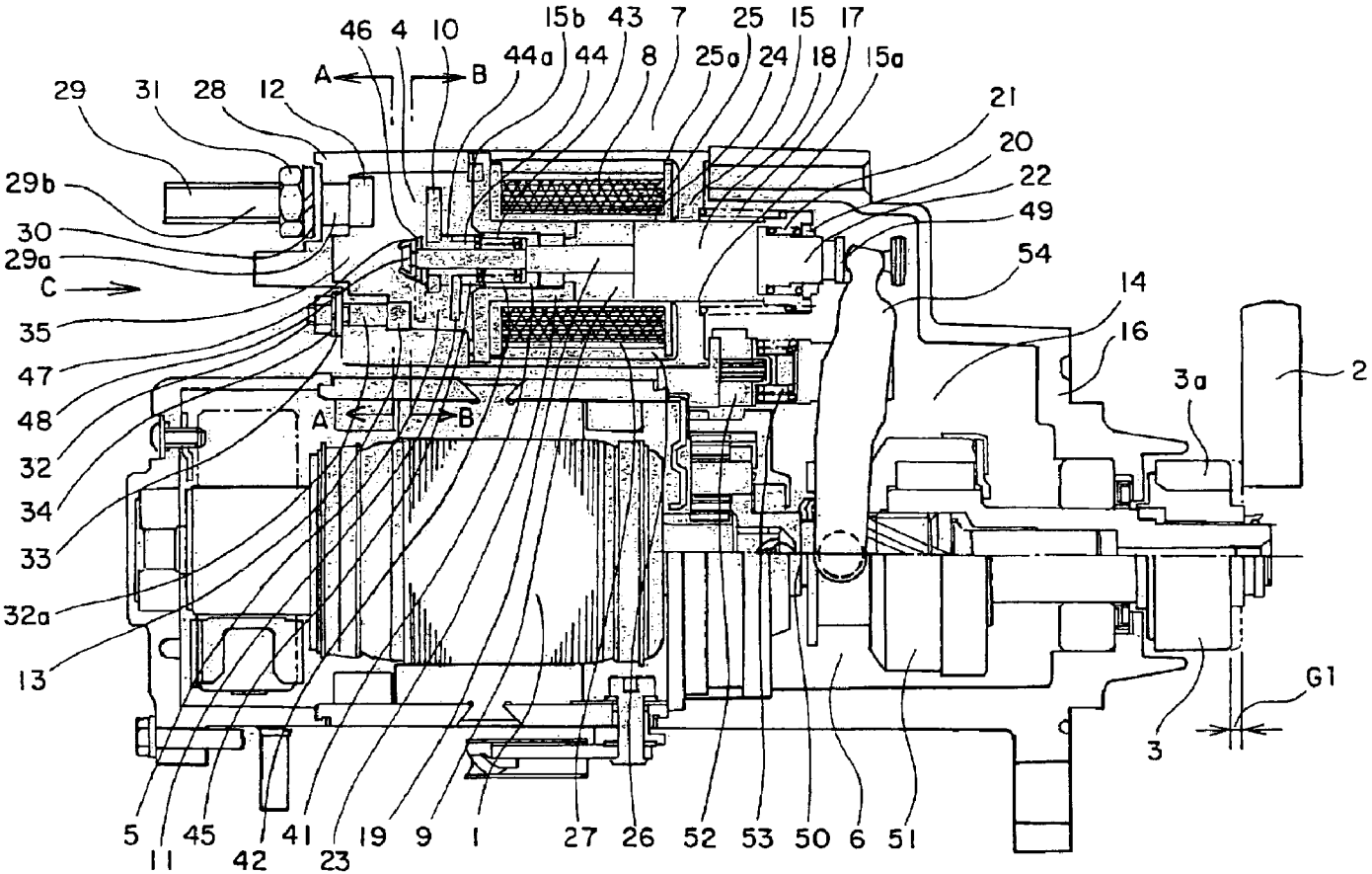
FIG. 1 is a sectional view of an engine starter according to Embodiment 1 of this invention.
Figure 2:
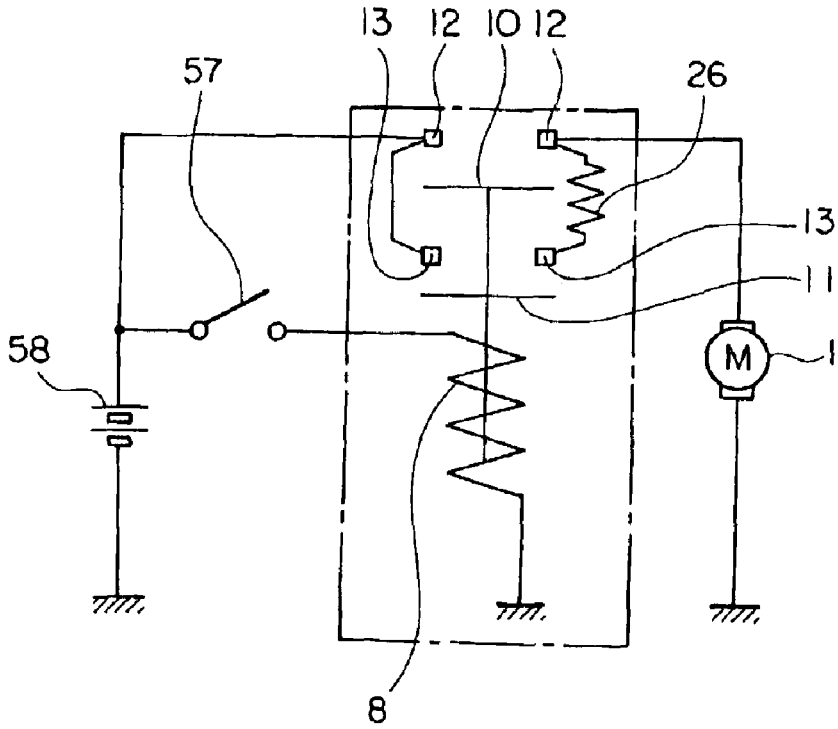
FIG. 2 is a circuit diagram of the engine starter of FIG. 1.
Figure 3:
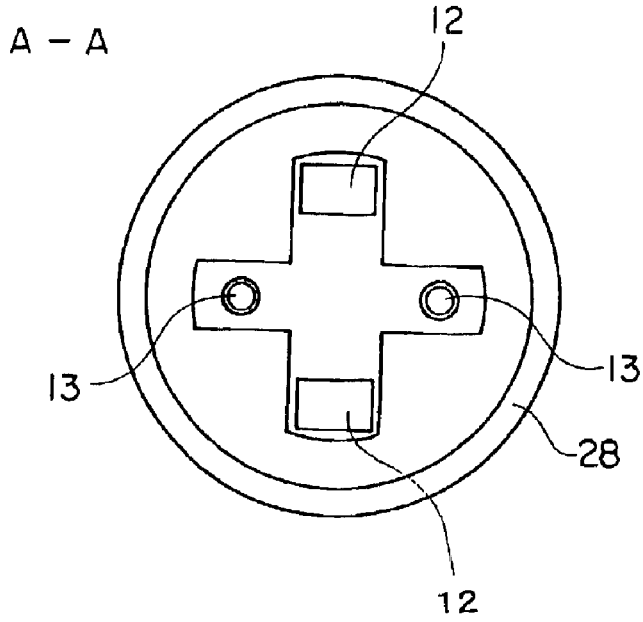
FIG. 3 is a sectional view taken along the line A—A of FIG. 1.
Figure 4:
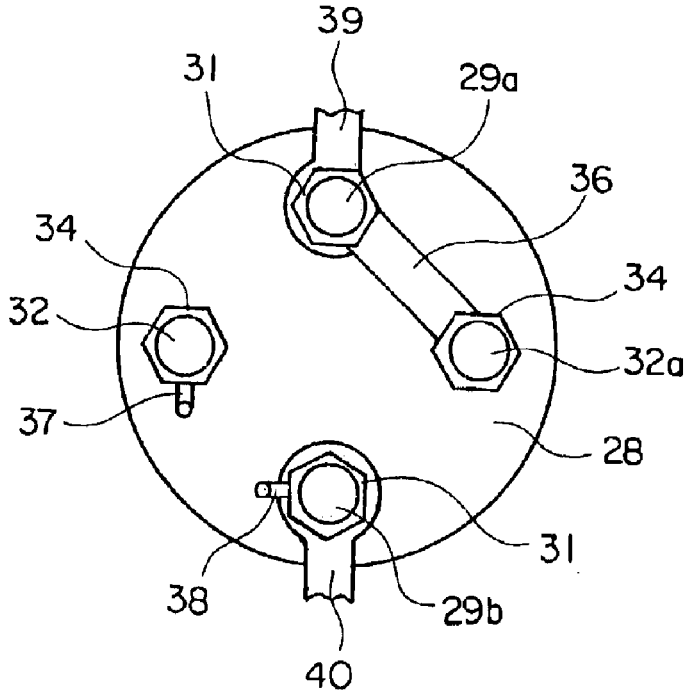
FIG. 4 is a side view as seen from the direction indicated by the arrow C of FIG. 1.
Figure 5:
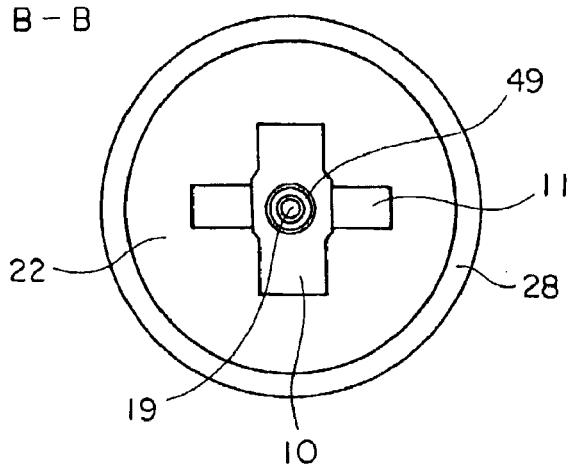
FIG. 5 is a sectional view taken along the line B—B of FIG. 1.
Figure 6:
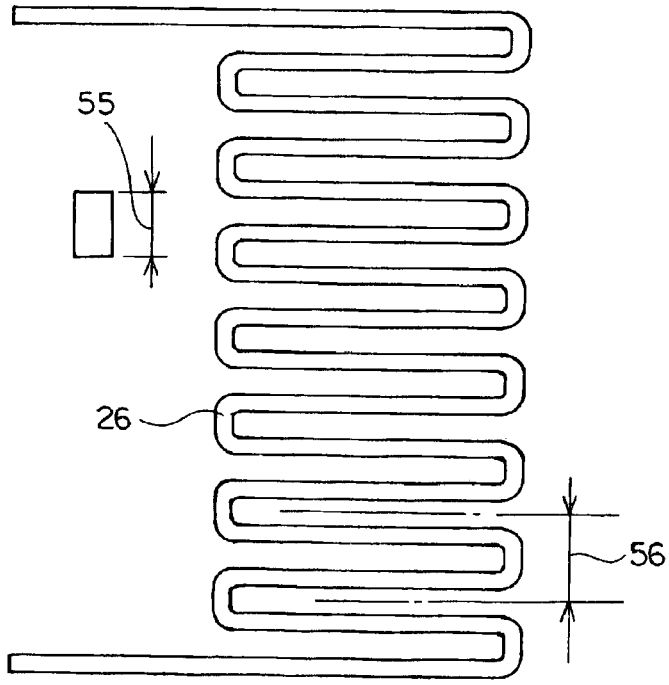
FIG. 6 is a planar development of the resistor of FIG. 1.
Figure 7:
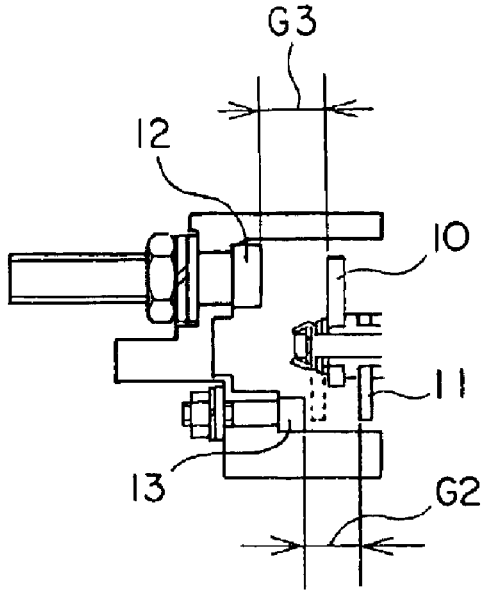
FIG. 7 is an enlarged view of the contact chamber of FIG. 1.

FIG. 1 is a sectional view of an engine starter according to Embodiment 1 of this invention; FIG. 2 is a circuit diagram of the engine starter of FIG. 1; FIG. 3 is a sectional view taken along the line A—A of FIG. 1; FIG. 4 is a side view as seen from the direction indicated by the arrow C of FIG. 1; FIG. 5 is a sectional view taken along the line B—B of FIG. 1; FIG. 6 is a development of the resistor of FIG. 1; FIG. 7 is an enlarged view of the contact chamber of FIG. 1; and FIGS. 8A and 8B are enlarged views of the plunger assembly of FIG. 1.

The engine starter of an internal combustion engine is equipped with a starter motor 1, a pinion 3 driven by the starter motor 1 to move toward and away from a ring gear 2 of the engine so as to be engaged therewith, and a starter switch 7 having a main contact 4 and an auxiliary contact 5 for driving the starter motor 1 at first and second speeds and a drive mechanism 6 for causing the pinion 3 to advance and retract.

The starter switch 7 is equipped with a switch coil 8, a plunger assembly 9 which is moved between a non-operating position and an operating position by the switch coil 8, a main movable contact 10 and an auxiliary movable contact 11 provided in the plunger assembly 9, a main stationary contact pair 12 and an auxiliary stationary contact pair 13 that the main movable contact 10 and the auxiliary movable contact 11 can come into contact with and be separated from, and an operating member 14 provided between the plunger assembly 9 and the pinion 3 and adapted to cause the pinion 3 to advance and retreat.

The plunger assembly 9 is equipped with a cylindrical movable element 18 arranged so as to be capable of being shifted in the axial direction of a magnetically permeable pot-like casing 15 and urged toward a front bracket 16 by a movable element return spring 17 provided between a side surface 15*a* on the front bracket 16 side of the casing 15 and a stepped peripheral portion 18*a* provided on the side surface 15*a,* a switching shaft 19 fixed to the movable element 18, and a shaft 22 urged in the direction of the switching shaft 19 by a shaft urging spring 21 whose one end is supported by a ring 20 fixed to an end portion 18*b* of the movable element 18.

The engine starter is further equipped with a magnet core 23 crimped onto a retaining portion 15*b* of the casing 15, opposed to the movable element 18, and having a through-hole 23*a* at its center axis, a cylindrical guide sleeve 24 surrounding the outer periphery of the movable element 18 and slidably guiding the movable element 18, a coil housing 25 concentrically surrounding the guide sleeve 24, a switch coil 8 accommodated in the coil housing 25 and having an outer diameter smaller than that of a flange portion 25*a* of the coil housing 25, and a resistor 26 in contact with the outer periphery of the flange portion 25*a* of the coil housing 25, having its inner periphery opposed to the outer periphery of the switch coil 8 with a gap therebetween, and having its outer periphery in intimate contact with the casing 15, the gap being filled with air forming a heat insulating layer 27.

The engine starter is further equipped with a cup-shaped switch cover 28 fixed to the side of the magnet core 23 opposite to the front basket 16, two first bolt terminals 29 extending through an end surface 28*a* of the switch cover 28 opposed to the magnet core 23 and fixed thereto, a main stationary contact pair 12 connected to end portions 29*a* of the first bolt terminals 29 on the magnet core 23 side, nuts 31 fastened to end portions 29*b* of the first bolt terminals 29 outside the switch cover 28 through the intermediation of flat washers 30, two second bolt terminals 32 extending through the end surface 28*a* of the switch cover 28 opposed to the magnet core 23 and fastened thereto, an auxiliary stationary contact pair 13 connected to end portions 32*a* of the second bolt terminals 32 on the magnet core 23 side, and nuts 34 fastened to end portions 32*b* of the second bolt terminals 32 outside the switch cover 28 through the intermediation of flat washers 33. Further, there is formed a contact chamber 35 having a main stationary contact pair 12 and an auxiliary stationary contact pair 13.

One bolt terminal 29*a* of the first bolt terminals 29 (See FIG. 4) and one bolt terminal 32*a* of the second bolt terminals 32 (See FIG. 4) are connected by a conductive terminal 36, and lead wires 37 and 38 of the resistor 26 (See FIG. 4) are connected between the other first bolt terminal 29*b* and the other second bolt terminal 32*b*. At the same time, a connection line led out from a battery (not shown) is connected to the one bolt terminal 29*a* of the first bolt terminal 29 (See FIG. 4), and a connection line 40 connected to the armature of the starter motor 1 (See FIG. 4) is connected to the other bolt terminal 29*b* of the first bolt terminal 29.

The engine starter is further equipped with a two-stepped switching shaft 19 fixed to the movable element 18, extending to the contact chamber 35, and having a longitudinal central step portion 19*a* with a reduction in diameter, a cylindrical spring bearing 41 retained at the central step portion 19*a,* two coil springs 42 and 43 supported at one end by the spring bearing 41 and arranged coaxially, a first insulating bush 44 supported by the coil spring 42, held in intimate contact with the outer peripheral surface of the switching shaft 19, and having a stepped peripheral portion 44*a*, a second insulating bush 45 guided by the outer peripheral surface of the first insulating bush 44 and supported by the coil spring 43, a rectangular main movable contact 10 having one surface in contact with the side surface of the stepped peripheral portion 44*a* on the contact chamber 35 side and the other surface in contact with an insulating washer 46, fixed by a holder 47 and a retaining ring 48, and cooperating with the main stationary contact pair 12, and an auxiliary movable contact 11 firmly attached to the second insulating bush 45, guided by the outer peripheral surface of the first insulating bush 44 to slide in the direction of the switching shaft 19, and cooperating with the auxiliary stationary contact pair 13.

The engine starter further includes, as the operating member 14 of the drive mechanism 6 for the pinion 3, an insulating material bush 49 connected to the front bracket 16 side of the shaft 22, and a claw-like lever 54 having one end rotatably supported by the insulating material bush 49 and the other end rotatably supported by a clutch 51 engaged with a motor rotation shaft 50 of the starter motor 1 and supported by a lever support portion 52 through the intermediation of a lever spring 53.

The operation range of the pinion 3 is between the non-operating position and the position where the ring gear 2 is engaged with a spline 3*a* of the pinion 3. The movable element return spring 17 pressurizes the clutch 51 to the left as seen in FIG. 1 through the intermediation of the lever 54, and the non-operating position of the pinion 3 is the position where the clutch 51 is at rest on the left-hand side in FIG. 1.

As shown in FIG. 1, the gap G1 between the opposing end surfaces of the pinion 3 and the ring gear 2 corresponds to the distance through which the pinion 3 moves between the non-operating position and the position where the end surface of the pinion 3 abuts the end surface of the ring gear 2 and where it is not engaged with the spline 3*a*.

As shown in FIG. 7, the auxiliary contact gap G2 between the auxiliary movable contact 11 and the auxiliary stationary contact pair 13 corresponds to the distance between the non-operating position of the auxiliary movable contact 11, that is, the position where the auxiliary movable contact 11 is at rest with the clutch 51 being at rest after being pushed to the left, and the auxiliary stationary contact pair 13.

As shown in FIG. 7, the main contact gap G3 between the main movable contact 10 and the main stationary contact pair 12 corresponds to the distance between the non-operating position of the main movable contact 10, that is, the position where the main movable contact 10 is at rest with the clutch 51 being at rest after being pushed to the left in FIG. 1, and the main stationary contact pair 12.

Assuming that the maximum moving distance of the movable element 18 when the attraction current is turned on and off with respect to the switch coil 8 is L (mm), the switching shaft 19 fixed to the movable element 18 is moved by the same distance. When it moves by the auxiliary contact gap G2 of the movable element 18, the auxiliary movable contact 11 abuts the auxiliary stationary contact pair 13 to close the auxiliary contact 5. Since the movable element 18 further moves, the coil spring 43 is compressed by a length corresponding to the push-in amount K1 of the auxiliary movable contact 11 to secure the requisite contact pressure. Similarly, the coil spring 42 is compressed by a length corresponding to the push-in amount K2 of the main movable contact 10 to secure the requisite contact pressure for the main contact 4. That is, the sum total of the auxiliary contact gap G2 and the auxiliary movable contact push-in amount K1 is L, and the sum total of the main contact gap G3 and the main movable contact push-in amount K2 is equal to L. In FIG. 1, the main contact gap G3 is larger than the auxiliary contact gap G2, so that the auxiliary movable contact push-in amount K2 is larger than the main movable contact push-in amount K1.

Figure 8:
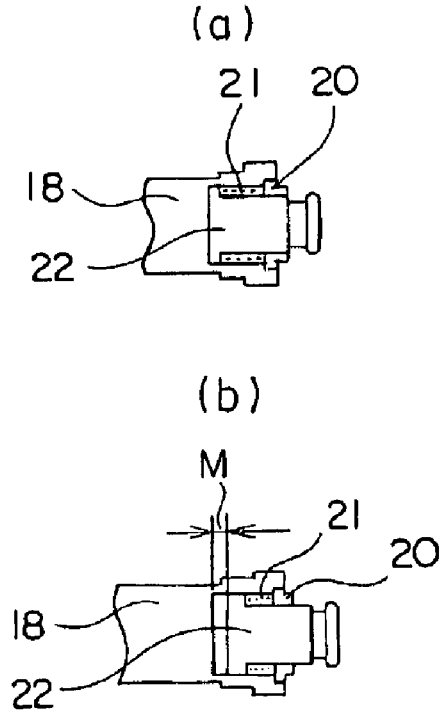
FIGS. 8A and 8B are enlarged views of the plunger assembly of FIG. 1.

As shown in FIG. 8, regarding the moving amount of the shaft 22, when the shaft 22 moves to the left as seen in FIG. 1, the shaft urging spring 21 is compressed, so that the moving amount N (mm) is smaller than the moving distance of the movable element 18 by the compression amount M (mm), and there is a gap between the switching shaft 19 and the shaft 22.

In FIG. 1, the sum of the gap G1 between the opposing end surfaces of the pinion 3 and the ring gear 2 and the compression amount M (mm) shown in FIG. 8 is smaller than the auxiliary contact gap G2 shown in FIG. 7.

As shown in FIG. 6, by setting the width 55 and pitch 56 of the resistor and forming a resistor plate out of a copper/nickel alloy, a resistor 26 having a desired rated power and a desired resistance value is obtained. That is, when the rated power is to be increased, the width 55 is increased, and the pitch 56 is diminished accordingly to thereby increase the length of the resistor 26, whereby it is possible to easily obtain a resistor 26 of a different rated power but of the same resistance value. To produce the resistor 26, a resistor plate is stamped in a meandering fashion and worked into a cylindrical shape, and then subjected to insert molding using phenol resin. In order that it may be held in intimate contact with the inner wall of the casing 15, the outer diameter of the cylindrical resistor 26 is made substantially equal to the inner diameter of the casing 15. On the other hand, the inner diameter of the resistor 26 is made larger than the outer diameter of the switch coil 8, and the resistor 26 and the switch coil 8 are thermally insulated from each other by an air layer forming the heat insulating layer 27.

The timing with which the main contact and the auxiliary contact of the engine starter are opened and closed will be described. As shown in the circuit diagram of FIG. 2, when a hand start switch 57 is turned on, an electric current from a battery 58 flows through the switch coil 8, and a magnetic force acts so as to attract the movable element 18 in the direction of the magnet core 23, the movable element 18 compressing the movable element return spring 17 to be attracted to the left as seen in FIG. 1. The shaft urging spring 21 firmly attached to the end portion of the movable element 18 is compressed, and the shaft 22 is moved to the left in FIG. 1. The insulating material bush 49 connected to the shaft 22 moves to the left in FIG. 1, and the lever 54 rotates counterclockwise as seen in FIG. 1 around the lever spring 53, and the pinion 3 moves to the right in FIG. 1 to abut the end surface of the ring gear 2. At this time, even if the compression amount M (mm) of the shaft urging spring 21 is taken into account, the auxiliary movable contact 11 does not abut the auxiliary stationary contact pair 13, and the main movable contact 10 does not abut the main stationary contact pair 12. When the end surface of the pinion 3 abuts the end surface of the ring gear 2, the support point of the lever 54 with respect to the clutch 51 cannot move, and since the movable element 18 is under a force to the left in FIG. 1, the lever spring 53 is deflected, and the auxiliary movable contact 11 moves to the left in FIG. 1 to be connected to the auxiliary stationary contact pair 13. When the auxiliary movable contact 11 and the auxiliary stationary contact pair 13 are connected to each other, an electric current flows from the battery 58 to the motor starter 1 by way of the resistor 26. Since this electric current flows by way of the resistor 26, the current value increases gently, and the rotating speed of the starter motor 1 also increases gently. The pinion 3 rotates, with its end surface in contact with the end surface of the ring gear 2, and mutual engagement is effected when the spline 3*a* of the pinion 3 and the teeth of the ring gear 2 are matched with each other.

When the ring gear 2 is engaged with the spline 3*a* of the pinion 3, the movable element 18 moves further to the left in FIG. 1 due to the return force of the lever spring 53, which has been deflected, and the switching shaft 19 moves to the left. In the state in which the clutch 51 has moved substantially to the full, the main movable contact 10 is connected to the main stationary contact pair 12, and an electric current flows from the battery 58 to the starter motor 1, with the result that the motor 1 performs rated rotation to start the engine.

When the main contact is closed, due to the presence of the resistor 26 between the auxiliary contacts, the impedance of the circuit on the auxiliary contact side is far greater than that of the circuit on the main contact side, so that during rated rotation, substantially no current flows through the circuit on the auxiliary contact side.

Even after the closing of the auxiliary stationary contact pair 13, the auxiliary movable contact 11 further moves to the left in FIG. 1, so that the coil spring 43 is compressed. When the main contact is closed and rated motor current is flowing, a predetermined contact pressure is imparted on the auxiliary movable contact 11.

Next, when the engine is started, and the hand start switch 57 is turned off, the voltage application to the switch coil 8 is cut off, so that no attraction force acts on the movable element 18 so as to move it to the left in FIG. 1, so that the movable element 18 moves to the right in FIG. 1 due to the urging force of the movable element return spring 17, and the main movable contact 10 is separated from the main stationary contact pair 12. Further, since a gap is formed between the movable element 18 and the shaft 22, the switching shaft 19 moves to the right in FIG. 1 independently of the return movement of the shaft 22, and the auxiliary movable contact 11 is separated from the auxiliary stationary contact pair 13 to be opened.

The internal combustion engine was repeatedly started by this engine starter with the circuit configuration shown in FIG. 2 without the engine failing to start.

Further, measurement of the current flowing through the resistor showed that practically no current flows therethrough after the energization of the switch coil is cutoff; after repeated starting of the combustion engine, the resistance value of the resistor was substantially the same as that at the time of production.

Further, after repeatedly starting of the internal combustion engine, the starter was dismantled for observation of the end surface of the ring gear and the spline surface of the pinion; the surface roughness was less than that in the prior art.

In this engine starter, the hand start switch 57 was repeatedly turned on and off to measure the temperature rise in the switch coil 8 and the resistor 26; the temperature rise was approximately half that in the prior art.

Further, even after repeated turning on and off of the switch at a temperature of 125 degrees in order to accelerate the variation in the resistance value of the resistor, the variation in the resistance value was less than that in the prior art.

In this engine starter, when the switch coil is energized, the pinion first abuts the opposing end surface of the ring gear at rest, and then the auxiliary contact is closed to cause an electric current to flow through the circuit connected in series to thereby gently start the rotation of the pinion, effecting engagement of the pinion spline while the pinion end surface slides on the ring gear, whereby the possibility of failure in the engagement of the pinion with the ring gear is reduced.

Further, when the energization of the switch coil is cut off, and the movable element is returned to the non-operating position, the switching shaft moves, after the opening of the main contact, so as to fill the gap formed between the shaft and the switching shaft, independently of the returning movement of the shaft, so that the auxiliary contact is also opened without delay after the opening of the main contact, and no current flows through the resistor.

Further, since the main contact gap and the auxiliary contact gap can be determined independently, there is no need to particularly improve the assembly accuracy, thereby achieving a reduction in cost.

Further, when the ring gear abuts the opposing surface of the pinion, the auxiliary contact is not closed even if the starter is assembled with usual accuracy, and the contact is closed after the deflection of the lever spring.

Further, when the pinion spline starts to be engaged with the ring gear, the pinion spline is quickly engaged with the ring gear due to the return force of the lever spring, so that the ring gear and the pinion rotate while being engaged with each other with a wide abutment surface, whereby there is little damage to the abutment surfaces of the ring gear and the pinion.

In this engine starter, even if a large current repeatedly flows through the resistor to cause it to generate heat, the switch coil does not suffer heat damage since the resistor and the switch coil are thermally insulated from each other by the heat insulating layer.

Conversely, there is less change with passage of time in the resistance value of the resistor due to the heat conducted to the resistor from the switch coil generating heat.

Further, since the heat insulating layer is formed of air layer, it is possible to reduce the heat conduction.

Further, when increasing the rated power, the width of the resistor is increased, and the pitch is reduced accordingly to increase the length of the resistor, whereby it is possible to easily obtain a resistor of a different rated power but of the same resistance value.

Further, if resistors of different resistance values and rated powers are obtained from the same resistor plate, there is no need to change the casing since the resistor plate thickness is the same.

While in the above-described embodiment the heat insulating layer consists of an air layer, it may also consist of a low heat conductor with gas trapped therein like a foamed material.

Embodiment 2

Figure 9:
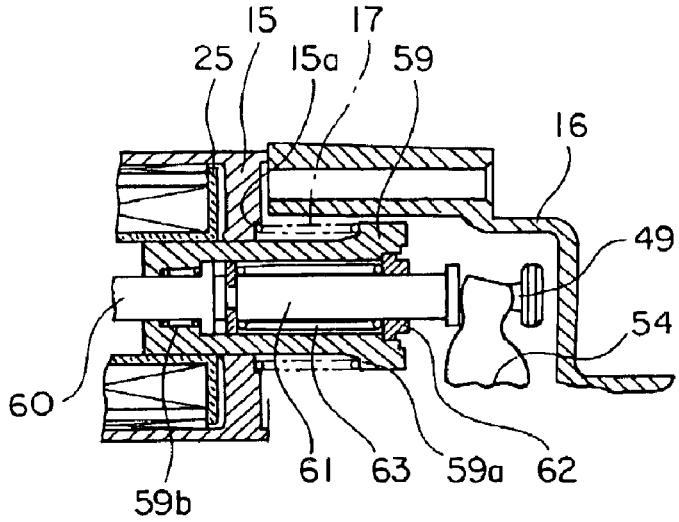
FIG. 9 is a partial sectional view of an engine starter according to Embodiment 2 of this invention, showing the movable element, shaft, and switching shaft thereof.

FIG. 9 is a sectional view of the movable element, shaft, and switching shaft of an engine starter according to Embodiment 2 of this invention. In FIG. 9, only the movable element, shaft, and switching shaft are different from those of Embodiment 1, and the other components are of the same construction, so that a description thereof will be omitted.

A movable element 59 is formed as a cylinder to be guided by a guide sleeve 24 provided in the inner periphery of a coil housing 25. A movable element urging spring 17 is provided between the front bracket 16 side end surface 15*a* of the casing 15 and the stepped peripheral portion 59*a* of the outer side surface of the movable element 59, whereby the movable element 59 is urged toward the front bracket 16. A switching shaft 60 which extends through the center hole

59*b* of the movable element 59 is fixed to the movable element 59. When the movable element 59 is at rest at the non-operating position, a shaft 61 is urged toward the end surface 60*a* of the switching shaft 60 and abuts the same. The shaft 61 is urged by a shaft urging spring 63 supported by a ring 62 fixed to the front bracket 16 side end portion of the movable element 59. An outwardly protruding stepped peripheral portion 59*b* is provided at the front bracket side end portion of the movable element 59, and the movable element 59 is urged toward the front bracket 16 by a movable element returning spring 3 provided between it and the front bracket 16 side end surface 15*a* of the casing 15. As in the case of FIG. 1, an insulating material bush 49 is fixed to the front bracket 16 side of the shaft 61, and a lever 54 is rotatably supported by the insulating material bush 49.

The timing with which the main contact and the auxiliary contact of the engine starter are opened and closed will be described with reference to FIG. 7; for the portions that are the same as those of Embodiment 1, FIGS. 1 and 2 will be referred to. As shown in the circuit diagram of FIG. 2, when the hand start switch 57 is turned on, an electric current flows to the switch coil 8 from the battery 58, and a magnetic force acts so as to pull the movable element 59 in the direction of the magnet core 23, the movable element 59 compressing the movable element returning spring 17 to be attracted to the left in FIG. 7. The ring 62 fixed to the end portion of the movable element 59 compresses the shaft urging spring 63 to move the shaft 61 to the left in FIG. 7; since the lever 54, the clutch 51, the pinion 3, etc. are connected to the shaft 61, it moves to the left in FIG. 7. Since the shaft 61 moves through a distance smaller than the moving distance of the movable element 59, a gap is formed between the shaft and the end surface of the movable element 59 opposed to the shaft 61. As in Embodiment 1, due to the influence of the gap thus formed, the ring gear 2 first abuts the pinion 3, and then the lever spring 53 is deflected, whereby the auxiliary contact is closed, and the spline 3*a* of the pinion 3 is substantially engaged with the ring gear 2 before the main contact is closed to cause the starter motor to perform rated rotation.

Next, when the engine is started and the hand start switch 57 is turned off, the voltage application to the switch coil 8 is cut off, so that there is no force attracting the movable element 59 to the left in FIG. 7. Thus, the movable element 59 moves to the right in FIG. 1 due to the urging force of the movable element returning spring 17, and the main contact is opened. Further, since a gap is formed between the movable element 59 and the shaft 61, the switching shaft 60 to which the movable element 59 is connected moves to the right in FIG. 1 independently of the returning movement of the shaft 61 to open the auxiliary contact.

In this engine starter also, when the starter coil is energized, as in Embodiment 1, the pinion first abuts the opposing end surface of the ring gear at rest. Thereafter, the auxiliary contact is closed, and an electric current flows through a circuit in which a resistor is connected in series, whereby the spline of the pinion is engaged with the ring gear while the ring gear slides on the end surface of the pinion which has started to rotate gently, so that it is possible to reduce the possibility of failure in the engagement of the pinion with the ring gear.

Further, when the energization of the switch coil is cut off, and the movable element is returned to the non-operating position, after the opening of the main contact, the switching shaft moves so as to fill the gap formed between the shaft and the switching shaft independently of the returning movement of the shaft, so that the auxiliary contact is also opened without delay after the opening of the main contact, and no electric current flows through the resistor.

Embodiment 3

Figure 10:
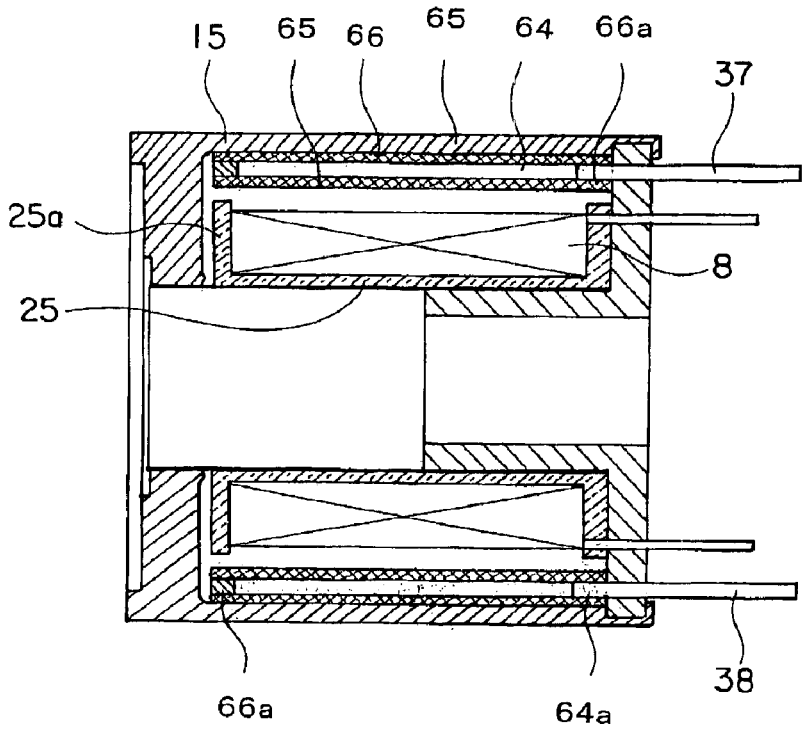
FIG. 10 is a sectional view of an engine starter according to Embodiment 3 of this invention, showing the switch coil, resistor, and casing thereof.

FIG. 10 is a partial sectional view showing the switch coil, resistor, and casing of an engine starter according to Embodiment 3 of this invention. The other components are the same as those of Embodiment 1, so that a description thereof will be omitted.

As in Embodiment 1, a resistor 64 is formed by stamping from a resistor plate, and is shaped in a meandering configuration. The resistor 64 is inserted into a retainer 66 composed of two concentric resin cylinders 65, and the end portions 66*a* of the retainer 66 are sealed by phenol resin while pulling the end portions 64*a* of the resistor 64 from the retainer 66. From the viewpoint of heat resistance, phenol resin is used.

Further, the outer diameter of the retainer 66 is in contact with the inner peripheral surface of the casing 15, and the inner diameter of the retainer 66 is larger than the outer diameter of the flange portion 25*a* of the coil housing 25, the coil housing 25 not being in contact with the retainer 66.

Since the retainer 66 insulates the air on the inner side from the air on the outer side, no convection of air occurs, so that the heat conduction is further reduced.

Further, since the retainer 66 can be formed of only resin, it is possible to select the material without taking into account the insert molding property.

As described above, in accordance with this invention, there is provided an engine starter including a starter motor, a pinion driven by the starter motor and capable of advancing and retreating with respect to a ring gear of an engine for engagement therewith, and a starter switch having a main contact and an auxiliary contact for driving the starter motor at first and second speeds different from each other and a drive mechanism for causing the pinion to advance and retreat. In the engine starter, the starter switch is equipped with a switch coil, a plunger assembly moved between a non-operating position and an operating position by the switch coil, a main movable contact and an auxiliary movable contact provided in the plunger assembly, a main stationary contact pair and an auxiliary stationary contact pair with which the main movable contact and the auxiliary movable contact can be brought into and out of contact, and a drive mechanism provided between the plunger assembly and the pinion and adapted to cause the pinion to advance and retreat, and the plunger assembly is equipped with a movable element driven between the non-operating position and the operating position by the switch coil, and a shaft elastically supported by the movable element so as to be movable in the moving direction of the movable element and connected to the drive mechanism with a gap variable with respect to the movable element. When the plunger assembly is at the non-operating position, the size of the gap between the main stationary contact pair and the main movable contact is smaller than the sum total of the size of the gap between the pinion and the ring gear and the size of the variable gap when opened to the utmost, so that as the plunger assembly moves from the non-operating position to the operating position, the auxiliary contact is first closed to cause the starter motor to be driven at the first speed, and then the main contact is closed to cause the starter motor to be driven at the second speed. Thus, when the switch coil is energized, the ring gear first abuts the opposing end surface of the pinion at rest, and then the auxiliary contact is closed to cause an electric current to flow through a circuit connected in series, whereby the ring gear is engaged with the spline of the pinion while sliding on the end surface of the pinion that has gently started to rotate, thereby making it possible to reduce the possibility of failure in the engagement of the pinion and the ring gear.

Further, in accordance with the present invention, there is provided an engine starter including a starter motor, a pinion driven by the starter motor and capable of advancing and retreating with respect to a ring gear of an engine for engagement therewith, and a starter switch having a main contact pair and an auxiliary contact pair for driving the starter motor at first and second speeds different from each other, a resistor connected to the auxiliary contact pair, a switch coil for bringing the main and auxiliary contact pairs into and out of contact with each other, and a drive mechanism for causing the pinion to advance and retreat, in which the resistor is provided adjacent to the switch coil through the intermediation of a heat insulating layer, whereby even if a large electric current flows repeatedly through the resistor to cause it to generate heat, the switch coil does not suffer heat damage due to thermal insulation between the resistor and the switch coil by a low heat conductive material.

What is claimed is:

1. An engine starter comprising:

a starter motor;

a pinion driven by said starter motor and capable of advancing and retreating with respect to a ring gear of an engine for engagement therewith; and a starter switch having a main contact and an auxiliary contact for driving said starter motor at first and second speeds different from each other and a drive mechanism for causing said pinion to advance and retreat;

said starter switch comprising a switch coil, a plunger assembly movable between a non-operating position and an operating position by said switch coil, a main movable contact and an auxiliary movable contact provided in said plunger assembly, a main stationary contact pair and an auxiliary stationary contact pair with which said main movable contact and said auxiliary movable contact can be brought into and out of contact, and a drive mechanism provided between said plunger assembly and said pinion and adapted to cause said pinion to advance and retreat;

said plunger assembly comprising a movable element driven between the non-operating position and the operating position by said switch coil, and a shaft elastically supported by said movable element via a shaft urging spring so as to be movable in the direction of movement of said movable element and connected to said drive mechanism to form a variable gap with respect to said movable element;

the arrangement being such that, when said plunger assembly is at said non-operating position, the size of a gap between said main stationary contact pair and said main movable contact is larger than the sum total of the size of a gap between said pinion and said ring gear and the size of the variable gap when opened the most, whereby, as said plunger assembly moves from said non-operating position to said operating position, said auxiliary contact is first closed to cause said starter motor to be driven at said first speed, and then said main contact is closed to cause said starter motor to be driven at said second speed.

2. An engine starter according to claim 1, wherein the main movable contact and the auxiliary contact are independently supported by the plunger assembly.

3. An engine starter according to claim 1, wherein as the plunger assembly moves from the non-operating position, opposing end surfaces of the ring gear and the pinion abut each other, and then a lever spring supporting a lever provided in the drive mechanism is deflected to thereby close the auxiliary contact to which a resistor is connected in series.

4. An engine starter comprising:

a starter motor;

a pinion driven by the starter motor and capable of advancing and retreating with respect to a ring gear of an engine for engagement therewith; and a starter switch having a main contact pair and an auxiliary contact pair for driving the starter motor at first and second speeds different from each other, a resistor connected to the auxiliary contact pair, a switch coil for bringing the main and auxiliary contact pairs into and out of contact with each other, and a drive mechanism for causing the pinion to advance and retreat;

said resistor being disposed adjacent to said switch coil via a heat insulating layer.

5. An engine starter according to claim 4, wherein the heat insulating layer is an air layer surrounding the outer periphery of the switch coil.

6. An engine starter according to claim 4, wherein the resistor is contained and held in a retainer formed of resin surrounding the outer periphery of the switch coil.

7. An engine starter according to claim 5, wherein the resistor is contained and held in a retainer formed of resin surrounding the outer periphery of the switch coil.

8. An engine starter according to claim 4, wherein the resistor is one obtained by forming a piece cut from a resistor plate into a predetermined configuration.

* * * * *